US006645591B2

(12) United States Patent
Liebig, Sr.

(10) Patent No.: US 6,645,591 B2
(45) Date of Patent: Nov. 11, 2003

(54) COMPONENTS FOR COUNTERTOP ASSEMBLY AND FABRICATION

(76) Inventor: Theodore H. Liebig, Sr., 1516 Pacland Ridge Ct., Chesterfield, MO (US) 63005

( * ) Notice: Subject to any disclaimer, the term of this patent is extended or adjusted under 35 U.S.C. 154(b) by 0 days.

(21) Appl. No.: 09/847,455

(22) Filed: May 2, 2001

(65) Prior Publication Data

US 2002/0018867 A1 Feb. 14, 2002

Related U.S. Application Data

(60) Provisional application No. 60/201,886, filed on May 4, 2000.

(51) Int. Cl.[7] ..... A47B 96/18

(52) U.S. Cl. ..... 428/40.1; 52/741.1; 52/741.3; 52/745.9; 52/747.1; 156/71; 312/140.3; 312/140.4; 428/41.7; 428/41.8

(58) Field of Search ..... 52/741.1, 741.3, 52/745.19, 747.1; 156/71; 428/40.1, 41.7, 41.8; 312/140.3, 140.4; 108/27

(56) References Cited

U.S. PATENT DOCUMENTS 5,253,932 A * 10/1993 Nesovic ..... 312/140.3
6,335,091 B2 * 1/2002 Nelson et al. ..... 428/349

* cited by examiner

*Primary Examiner*—Nasser Ahmad
(74) *Attorney, Agent, or Firm*—Paul M. Denk

(57) ABSTRACT

This invention relates to new and improved components including decorative surfacing materials, high and low pressure laminates, wood materials used in the assembly and fabrication of countertops, cabinet tops, worktops, desktops, and other casework and fixtures, which have been surfaced on one side with double-faced adhesive tape to enable bonding these components together during assembly or fabrication operations.

3 Claims, 2 Drawing Sheets

COMPONENTS FOR COUNTERTOP ASSEMBLY AND FABRICATION

CROSS-REFERENCE TO RELATED APPLICATIONS

This application claims priority to Provisional Application Ser. No. 60/201,886, filed May 4, 2000, entitled COMPONENTS FOR COUNTERTOP ASSEMBLY AND FABRICATION, and which is incorporated herein by reference.

STATEMENT REGARDING FEDERALLY SPONSORED RESEARCH OR DEVELOPMENT

Not Applicable.

BACKGROUND OF THE INVENTION

In the prior art, various methods have been employed for over the past fifty years to assemble components during the fabrication of countertops, etc. Specifically, these methods included the use of: dangerous, highly flammable, non-compliant VOC (Volatile Organic Compounds) emitting contact adhesives; reactivated hot-melt adhesives requiring the use of ovens or irons; PVA (polyvinyl alcohol) adhesives (i.e. white glue) requiring the use of clamps, masking tape, and other methods of holding components in place during the drying cycle; nails, screws, and staples requiring the use of hand tools or power tools; water-borne contact adhesives which have a long history of unreliability often resulting in delamination of components.

The patent to Ornstein, U.S. Pat. No. 3,295,474, shows a wall mounted shelf assembly. The shelf and its components are held into position by means of a form of adhesive backing sheet. This holds the various portions of the shelf in place. But, the adhesive is only used for holding the vertical brackets of the shelf in place, and which are basically secured into the position by means of the various shown screws.

The patent to McLaurin, U.S. Pat. No. 2,031,275, shows an adhesively coated sheet material. The purpose of the gummed sheet material, which may be used in the form of a gummed tape, is to facilitate veneering operations.

The patent to Baker, U.S. Pat. No. 2,815,252, shows a nylon glide strip. This patent simply discloses the application of a nylon strip, apparently to reduce friction between a supporting surface or guide, while the drawer slides thereover, and attaining such reduction in friction through the application of its taped slides.

The patent to Krantz, U.S. Pat. No. 3,413,678, shows the use of a carpet tape, which is a double-faced adhesive, for holding carpeting in place, as is well known.

The patent to Gregov, U.S. Pat. No. 3,869,106, shows the application of safety bumper for furniture, and this bumper is also applied by means of a form of coated adhesive, that holds the bumper in place, once secured to the edge of furniture.

The patent to Glickman, U.S. Pat. No. 3,915,528, shows the application of a desk attachment, in the form of a protective panel, that is held in position upon the design by means of an adhesive coating. The adhesive coating is revealed, upon tearing back of its backing sheet.

The patent to Smith, U.S. Pat. No. 3,922,408, shows a corner and edge protector cover, not too unlike that as previously described in the two recently reviewed patents. It simply shows a protector, which may include a porous foam material, and an inner surface adhesive, which is pressure sensitive, and when the peel strip is removed, allows the corner protector to be applied to a counter.

The patent to Rutz, U.S. Pat. No. 5,208,084, shows another type of edge pad. This device simply shows the use of an adhesive strip for holding the pad in place, as to the edge of a desk, table, or the like.

The patent to Wacker, U.S. Pat. No. 5,301,616, shows a repositionable paper stop for a table surface. This is a stop means applied to the top surface of a table, which may be a tiltable table, as can be seen.

The patent to Adams, U.S. Pat. No. 5,750,227, shows a tiled surface covering. The tiles are applied by means of pressure sensitive adhesive, to the underlay sheet, for providing means for holding the tiles in place, once applied.

These are examples of prior art devices, as disclosed in previous patents.

These methods have been used to assemble components and fabricate countertops, etc., by the following: factory and shop workers employed to assemble or fabricate these products in an industrial environment; contractors and installers who are required to perform these tasks in the field or on job-sites; Do-It-Yourselfers (DIYers) who attempt to perform these tasks in their homes and offices.

Specifically, the components used in the assembly or fabrication process include—but are not limited to: Laminate pieces (End Caps) which are applied to the ends of countertops, etc., to finish these ends creating an aesthetic appearance and sealing them from moisture and other penetrating agents; Laminate strips (Edge Banding) which are applied to the edges of countertops, etc., to finish these edges creating an aesthetic appearance and sealing them from moisture and other penetrating agents; Laminate sheet (Decking) which is applied to the surface of panels (usually some type of hardwood, plywood, pressed wood, particle board, or other composite material of some type) to create a functional, decorative surface; Blocks and strips of wood (Buildup), including hardwood, plywood, pressed wood, particle board, or other composite material of some type; Pieces of laminated wood (End Splashes) which are applied at the end of countertops, etc., to protect the wall or the cabinetry at the end of a countertop; Acrylic or polyester pieces and sheets (Solid Surface) which may be used as an alternate product to laminate previously described.

SUMMARY OF THE INVENTION

Present day concerns shared by all manufacturers in the business of fabricating countertops, etc., and by contractors and installers who are engaged in completing the assembly and fabrication of countertops, etc., while in the field or on the job-site include safety, regulatory compliance, quality, and labor efficiency.

Although this invention is simple, its benefits are extremely important to these groups. What is claimed as new is the manner in which this invention addresses these four issues.

It is one of the objects of this invention to improve safety by eliminating the need to use extremely flammable solvent-based contact adhesives during the assembly of end caps, edge banding, decking and buildup. In most fire protection districts the use of such adhesives requires expensive application booths or is banned entirely. In areas where fire safety inspections are not conducted or where restrictions are not enforced, the use of such adhesives often results in fires and explosions. Additionally, overspray and excessive adhesive can only be removed from laminate surfaces through the use of extremely flammable solvent cleaners containing toluene and MEK (methyl ethyl ketone).

Hot melt adhesives are also used to assemble components. Handling components coated with hot melt at a temperature often in excess of 250° F. exposes employees to serious burn risk, and in fact, numerous such incidents occur regularly. While other bonding agents are available to, these, too, have many significant inherent deficiencies and disadvantages.

Another object of this invention is to encourage and enable compliance with local and federal regulations regarding emissions and effluents. Solvent-based adhesives are non-compliant in many municipalities, though are often used in violation of the VOC (Volatile Organic Compounds) standards set. Because environmental concerns continue to receive ever-increasing priority by local and federal authorities, it is anticipated that the use of solvent-based adhesives and solvent cleaners as described above in this application will be completely banned in several years. Although currently compliant in most areas, water-based solvents and some hot melts may also contain a modest percentage of solvents, and these are also being discontinued in some areas.

It is yet another object of this invention to improve or insure the quality of the finished countertop, etc. Failures of the bonds (delamination) in countertops, etc., have been documented extensively since the introduction of water-borne contact adhesives. While such adhesives eliminate fire risk and mitigate the consequences of non-compliance with emissions regulations, they have been proven to be very unreliable. Virtually every manufacturer, contractor, and installer in the countertop industry is keenly aware of the high potential for product failure when these adhesives are used. Additionally, the quality of bonds made using hot melts and PVA's is dependent upon a uniform adhesive coverage pattern, film thickness (amount of adhesive), temperature, and drying time. Deviation from tolerances in any of these parameters will result in delamination.

It is a further object of this invention to improve labor efficiency in manufacturing environments and on job-sites. Solvent-based and water-borne contact adhesives as well as PVA adhesives require drying time ranging from fifteen minutes to several hours. Depending on circumstances, this interim drying period often creates a significant amount of wasted time. And while hot melt adhesives dry within several minutes, the heat activation time can be excessive depending on the type of oven equipment utilized.

Another very important object of this invention is to address the above issues of safety, compliance, and quality on behalf of the millions of do-it-yourselfers who purchase thousands of countertops, etc., daily through home centers, kitchen dealers, hardware stores, lumberyards, etc. In many instances, these consumers are often left to their own devices when faced with the task of assembling components and completing the fabrication process. In other cases, the consumer is provided with components and instructions directing them in the use of the aforementioned bonding products. The most common bonding products involve the use of hot melt adhesive and a household iron. This particular method is neither safe nor efficient; requires the use of other tools; and leaves the quality of the final bond dependent upon the inexperienced do-it-yourselfer's skill in determining the precise reactivation temperature for the hot melt using a simple household iron and his/her fabricating ability. Additionally, because end caps are often precoated with hot melt intended to be reactivated using a household iron, expiration of the shelf life of the components results in bond failures.

This invention has as another of its objects the elimination of the aforementioned nails, screws, and staples. These methods of assembling components during the fabrication process require the use of either electric or pneumatic power tools or hand tools. Additionally the inexperienced do-it-yourselfer may easily use nails, screws, or staples of the wrong length, resulting in irreparable damage to the decorative surface of the countertop, etc.

These and other objects of this invention as well as a clearer understanding of their advantages will become apparent to those skilled in the art upon consideration of the accompanying specifications and drawings which form a further part thereof.

DESCRIPTION OF THE PREFERRED EMBODIMENT

Figure 1:
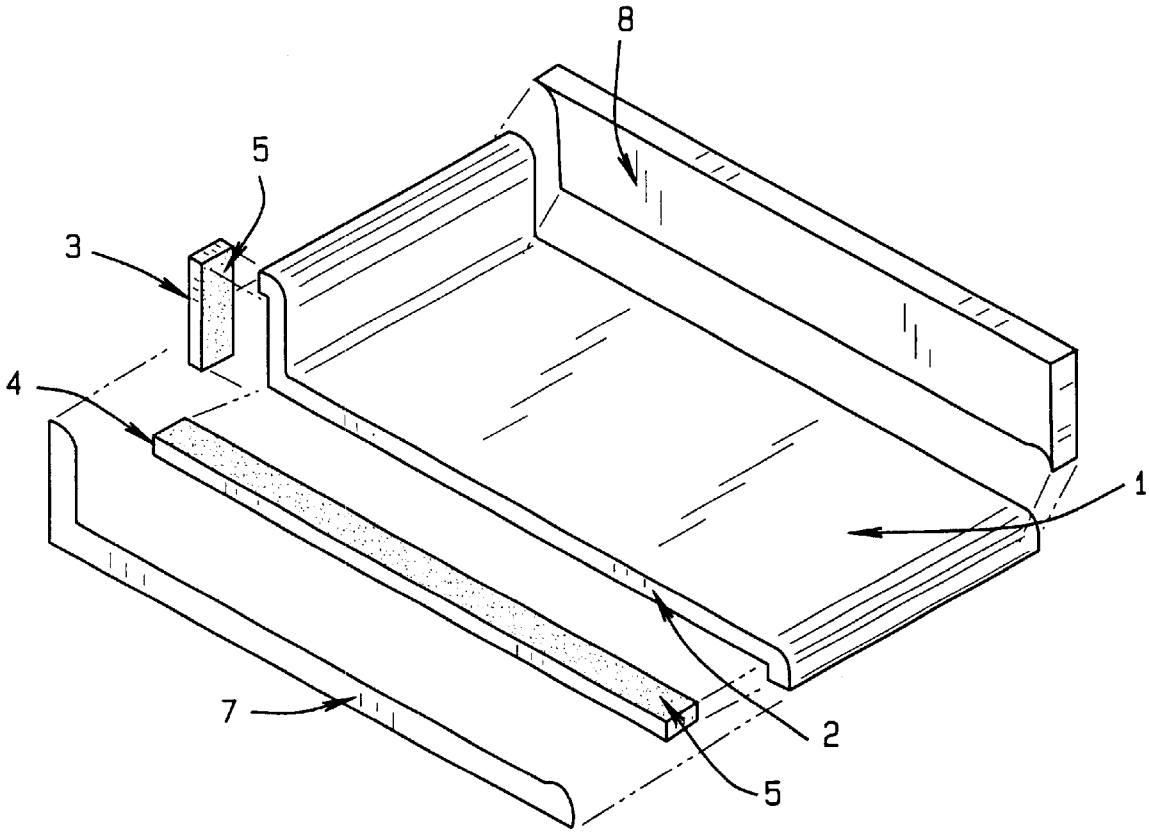
FIG. 1 is an exploded view of a small piece of countertop 1 and the components which are attached to it for the purposes of finishing the ends of a countertop. Specifically, these components include two pieces of buildup 3 and 4 pre-coated with double-sided adhesive tape 5, one end cap 7 with double-sided adhesive tape 5, and one end splash 8.

Referring to FIG. 1, a typical counter top includes a countertop 1; an end cap 7, a back splash 8, a build-up pieces 3 and 4. The two pre-cut pieces of buildup 3 and 4 must be attached to the countertop 1 before the end cap 7 can be applied to the countertop. These pieces of buildup have been pre-coated with double-sided adhesive tape 5. The adhesive tape 5 has a protective backing. Prior to attaching the build-up pieces to the countertop, the protective backing is removed from the adhesive. The advantage of this aspect of the invention is that no nails, screws, or staples are used, thereby eliminating the possibility of damage to the laminate surface of the countertop.

The end cap 7 is also pre-coated with a double sided adhesive, having a protective backing. After the buildup has been attached to the countertop, the protective backing is removed from the adhesive of the end cap 7, revealing the adhesive side of the tape 5 on the inner surface of the end cap. The adhesive side of the end cap is then pressed against the "built up" end of the countertop. The advantage of this aspect of the invention is the elimination of flammable and non-compliant adhesives, hot melt machines and reactivating devices, tapes and clamps required to hold the buildup or end cap in place during the adhesive drying cycle, and water-borne contact adhesives which have a long history of unreliability.

Figure 2:
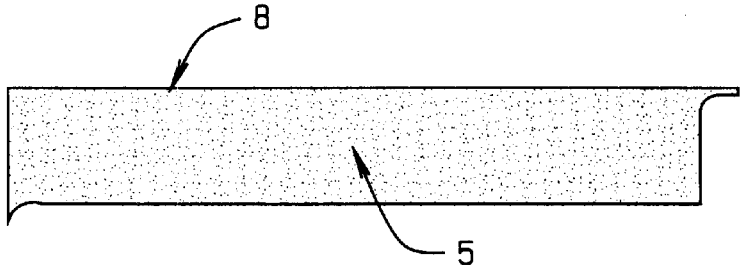
FIG. 2 is a side view of an end splash 8 with double-sided adhesive tape 5.

Referring to the end splash 8 in FIG. 2, one side has been pre-coated with double-sided adhesive tape 5, having a protective backing. Once the countertop has been properly attached to the cabinets, this end splash is set on the end of the countertop where the countertop butts against a wall and thereby protects the wall from soiling due to splashing.

Figure 3:
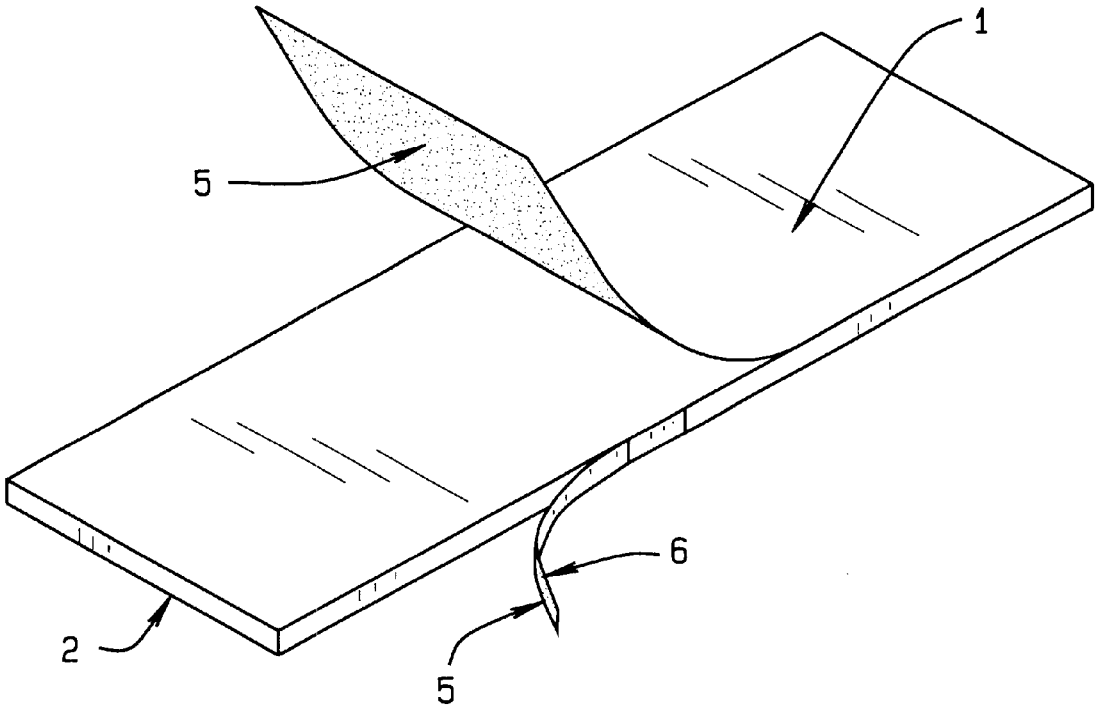
FIG. 3 is a perspective view of a panel or piece of countertop 2 depicting the decking material 1 and edge banding material 6 both of which are pre-coated with double-sided adhesive tape 5.
Figure 4:
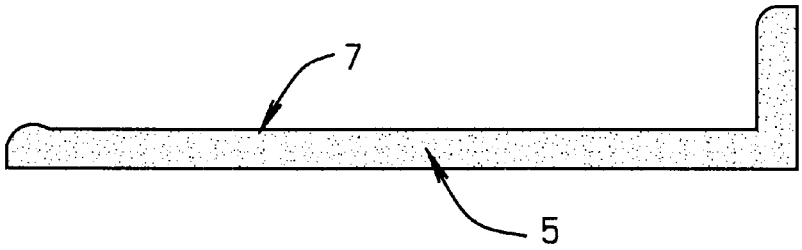
FIG. 4 is a side view of the end cap of FIG. 1.

FIG. 3 depicts how decking such as sheet laminate or solid surface material 10 and edge buildup 6 is applied to the countertop panel or substrate 2. Both the laminate 10 and the edge buildup 6 are pre-coated with double-sided adhesive tape 5 having a protective backing. At the time of assembly, the protective backing is removed and the decking 10 or edge banding 6 is applied to the substrate 2.

This invention results in the virtual elimination of equipment, tools, bonding agents, and energy consumption during the fabrication and assembly of a countertop. Due to the revolutionary manner in which the countertop is assembled, those skilled in the art such as factory and shop employees as well as contractors and installers are able to perform this work infinitely faster and safer and more economically. As has been demonstrated, this invention enables Do-It-Yourselfers to fabricate their own countertops safer and in a manner which clearly produces a truly professional result.

The novel feature of the invention is the application of double-faced adhesive tape to the various components used in the assembly and fabrication process of countertops, etc.

The use of this invention is completely safe with respect to the potential for explosion or fire which may result from the use of solvent-based contact adhesive or solvents used to clean up such adhesives as well as clean up waterborne contact adhesives.

The method of the invention does not any toxic fumes or hazardous VOC emissions which are released from contact adhesives and solvents required to bond components under the prior art.

Components assembled with tape are securely bonded in every instance. The shop fabricator, contractor, installer or do-it-yourselfers have no concerns regarding uniform adhesive coverage, film thickness, temperature achieved in ovens or in household irons, or drying times, as they would using the products currently available to them.

Because this invention requires no adhesive application time (two surfaces must be coated using any type of contact adhesive), no drying time, no equipment heat up time, and no tool or equipment set up time, this invention is incredibly efficient. It optimizes the use of time by shop personnel, contractors, and installers.

With respect to the vast, burgeoning do-it-yourself consumer market, this invention provides a safe, environmentally responsible, easy manner in which to fabricate a countertop, without exposing the do-it-yourselfer or others to toxic fumes, without the risk of burns, resulting from the handling of components coated with molten hot melt adhesive and without the use of certain tools and equipment. Further this invention guarantees the do-it-yourselfer a quality job comparable to that rendered by a craftsman with many years of experience.

Because nails, screws, and staples are not required when this invention is used, there is no possibility that the do-it-yourselfer will ruin his/her countertop by driving one of these fastening devices through the decorative surfaces of the countertop, etc.

Although the invention is described with respect to countertops, it will be appreciated by those skilled in the art that the invention has wider applicability. Hence, the term countertop is to be broadly construed to include items such as countertops, cabinet tops, worktops, desktops, and other casework and fixtures having a surface to which a sheet of laminate is applied.

I claim:

1. A countertop assembly, fabricated from various components, including a countertop, a back splash connecting with the back edge of the countertop, an end cap at least on one end of the countertop, said back splash and end cap being secured to the back edge and side edge of the countertop, a double sided adhesive sheet being cut generally to the configuration of the back edge and side edge of the countertop, and provided for securement of the back splash and end cap to the said countertop, said double sided adhesive having protective coating thereon prior to its usage, and capable of being removed for adherence to the countertop edges for securement of the back splash and end cap thereto.

2. The countertop assembly of claim 1 wherein end caps are provided to each side edge of the countertop through the double sided adhesive sheet.

3. A method of assembling a countertop comprising:

providing a laminated countertop;

providing a buildup, a backsplash, and an endcap for the countertop, the buildup, the backsplash, and the endcap all having a double sided adhesive tape adhered to one surface thereof, the adhesive tape having a removable protective coating;

providing a countertop substrate, a sheet of laminate sized and shaped to cover the substrate, and edging sized and shaped to cover side edges of the substrate, the sheet of laminate and edging all having a double sided adhesive tape adhered to one surface thereof, the adhesive tape having a removable protective coating;

removing the protective coating from the adhesive tape of the laminate and applying the laminate to the substrate, and removing the protective sheet from the edging and applying the edging to the side edges of the substrate;

removing the protective coating from the adhesive tape of the buildup, and applying the buildup to the countertop;

removing the protective coating from the adhesive tape of the backsplash, and applying the backsplash to the countertop after the countertop has been secured to a base; and removing the protective coating from the adhesive tape of the endcap, and applying the endcap to the countertop.

* * * * *